US005381674A

United States Patent [19]

Omori et al.

[11] Patent Number: 5,381,674

[45] Date of Patent: Jan. 17, 1995

[54] GENERATOR FOR ABSORPTION REFRIGERATING MACHINE

[75] Inventors: Toshiaki Omori, Chiba; Noriyuki Nishiyama; Naoyuki Inoue, both of Kanagawa, all of Japan

[73] Assignees: Ebara Corporation; Tokyo Gas Co., Ltd., both of Tokyo, Japan

[21] Appl. No.: 74,662

[22] Filed: Jun. 10, 1993

[30] Foreign Application Priority Data

Jun. 30, 1992 [JP] Japan ..... 4-194708

[51] Int. Cl.[6] ..... F25B 35/02

[52] U.S. Cl. ..... 62/497; 62/476; 122/19

[58] Field of Search ..... 62/476, 101, 497; 122/19

[56] References Cited

U.S. PATENT DOCUMENTS

| | | | |
|---|---|---|---|
| 3,254,507 | 6/1966 | Whitlow | 62/476 |
| 3,323,323 | 6/1967 | Phillips | 62/476 |
| 3,407,625 | 10/1968 | McDonald | 62/476 |
| 4,127,993 | 12/1978 | Phillips | 62/101 |

FOREIGN PATENT DOCUMENTS 60-228802 11/1985 Japan .
61-262502 11/1986 Japan .

*Primary Examiner*—Henry A. Bennet
*Assistant Examiner*—William C. Doerrler
*Attorney, Agent, or Firm*—Armstrong, Westerman, Hattori, McLeland & Naughton

[57] ABSTRACT

A compact generator for an absorption refrigerating machine that uses combustion gas as a heat source, which enables stable heating. The generator 1 has a dilute solution inlet 3, a solution outlet 4, and a vapor outlet 5. A multiplicity of heat transfer fins 6 are provided on the outer periphery of a drum shell 2 of the generator. A circulation guide 7 is provided along the inner periphery of the drum shell. Openings are respectively provided in the bottom and top of the circulation guide 7. The solution outlet 4 has an overflow weir 10. The vapor outlet 5 has a downwardly facing opening 11 inside the can of the generator. The dilute solution inlet 3 is provided with a mixing chamber 20 which is separated from the solution in the drum shell of the generator and where the solution in the drum shell and dilute solution from the dilute solution inlet mix with each other.

13 Claims, 6 Drawing Sheets

GENERATOR FOR ABSORPTION REFRIGERATING MACHINE

BACKGROUND OF THE INVENTION

1. Field of the Invention

The present invention relates to a generator for an absorption refrigerating machine and, more particularly, to a generator for an absorption refrigerating machine which uses combustion gas as a heat source.

2. Prior Art

As conventional generators for absorption refrigerating machines, flooded type flue and smoke tube generators have generally been employed mainly in large-sized absorption refrigerating machines. This type of generator suffers, however, from some disadvantages: That is, the holding solution quantity is large, and the starting characteristics are inferior. In addition, the heat transfer efficiency is not satisfactorily high, and it is difficult to reduce the overall size of the system.

To achieve a reduction in the overall size of the system, for example, employment of a once-through generator has been examined. With this type of generator, however, it is difficult to handle vapor generated in the tube, and stable running cannot readily be performed. For example, if vapor is localized in the tube, local overheating occurs, causing the problem of corrosion. In addition, the circulation of solution may be impaired by vapor lock or other similar problem, causing crystallization, depending upon the rate of generation.

SUMMARY OF THE INVENTION

(Problems which the Invention is to Solve)

It is an object of the present invention to solve the above-described problems of the prior art and to make a generator compact in an absorption refrigerating machine that uses combustion gas as a heat source and further to enable stable heating. More particularly, the present invention aims at providing a generator for a small-sized absorption refrigerating machine.

(Means for Solving the Problems)

To solve the above-described problems, the present invention provides a generator for an absorption refrigerating machine which uses a combustion gas as a heat source, the generator comprising: a dilute solution inlet; a solution outlet means having an overflow weir structure; a vapor outlet; a multiplicity of heat transfer fins provided on the outer periphery of a drum shell, that is, a can of the generator; and a circulation guide provided along the inner periphery of the drum shell. The circulation guide has openings respectively provided in the bottom and top thereof.

In the above-described generator, the vapor outlet preferably has a downwardly facing opening inside the drum shell of the generator. The opening of the vapor outlet is disposed above the overflow weir.

The solution inlet is preferably provided with a mixing chamber which is separated from a concentrated solution residing in the drum shell of the generator and where the solution in the drum shell and a dilute solution from the dilute solution inlet mix with each other. The mixing chamber may be provided as a separate member on a lateral end of the drum shell. Alternatively, the mixing chamber may be provided as a compartment inside the drum shell.

(Operation of the Invention)

By virtue of the above-described arrangement, the absorbent solution in the generator is heated in the area between the drum shell and the circulation guide to generate vapor, resulting in a vapor-liquid mixed phase condition. Consequently, the specific gravity of the solution decreases, causing an upward flow. The absorbent solution, which is in the vapor-liquid mixed phase condition, flows out from the top opening of the circulation guide. The liquid returns to the inside of the drum shell of the generator and reenters the circulation passage through the bottom opening so as to be heated and recirculated. The vapor is separated from the liquid in the top space and flows out from the vapor outlet.

As a result of the generation of vapor, the solution becomes a concentrated solution. Part of this solution flows out through the overflow weir. By virtue of the presence of the overflow weir, the quantity of solution held in the drum shell of the generator is kept greater than a predetermined value. The dilute solution is supplied into the drum shell of the generator from the solution inlet and mixed with the solution in the drum shell of the generator. The resulting mixture enters the circulation passage through the bottom opening of the circulation guide, thereby being sequentially concentrated on heating.

When the dilute solution mixes with the solution residing in the drum shell of the generator, vigorous boiling may occur due to the heat of mixing. If such boiling occurs. The apparent specific gravity of the solution in the drum shell of the generator lowers. As a result, the circulation of the vapor-liquid mixture in the area between the drum shell and the circulation guide may become unstable. To eliminate such influence, mixing of the dilute solution with the solution in the drum shell of the generator is carried out in a mixing chamber provided separately from the solution in the drum shell, thereby allowing the mixture to boil in the mixing chamber. Thus, the circulation of the solution is stabilized.

As described above, the area between the drum shell and the circulation guide is equivalent to the heat transfer part of the once-through type of generator, which enables heat transfer of high efficiency. In addition, holding of solution by the overflow weir provided in the drum shell is equivalent to the solution holding part of the flooded type of generator. Accordingly, mixing of the dilute solution with the solution in the drum shell of the generator has no effect on the solution holding part. Thus, the required stability can be ensured.

EMBODIMENTS

The present invention will be described below more specifically with reference to the accompanying drawings. However, it should be noted that the present invention not necessarily limited to these embodiments.

Embodiment 1

Figure 1:
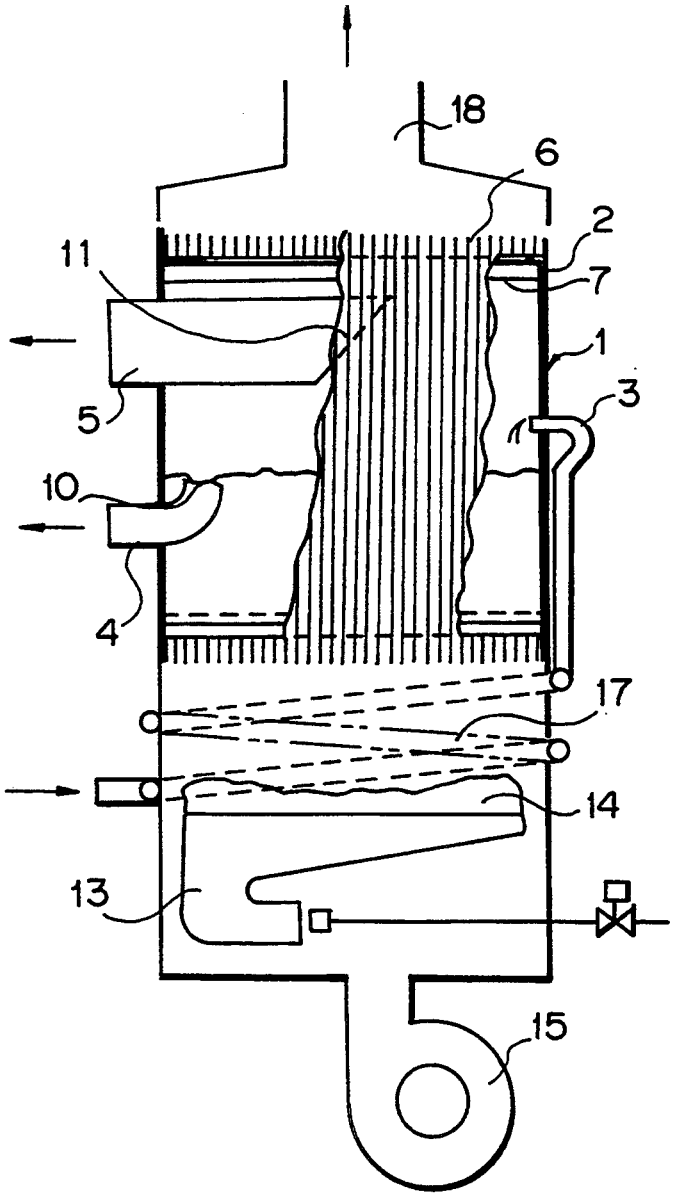
FIG. 1 is a sectional front view showing one embodiment of the present invention.
Figure 2:
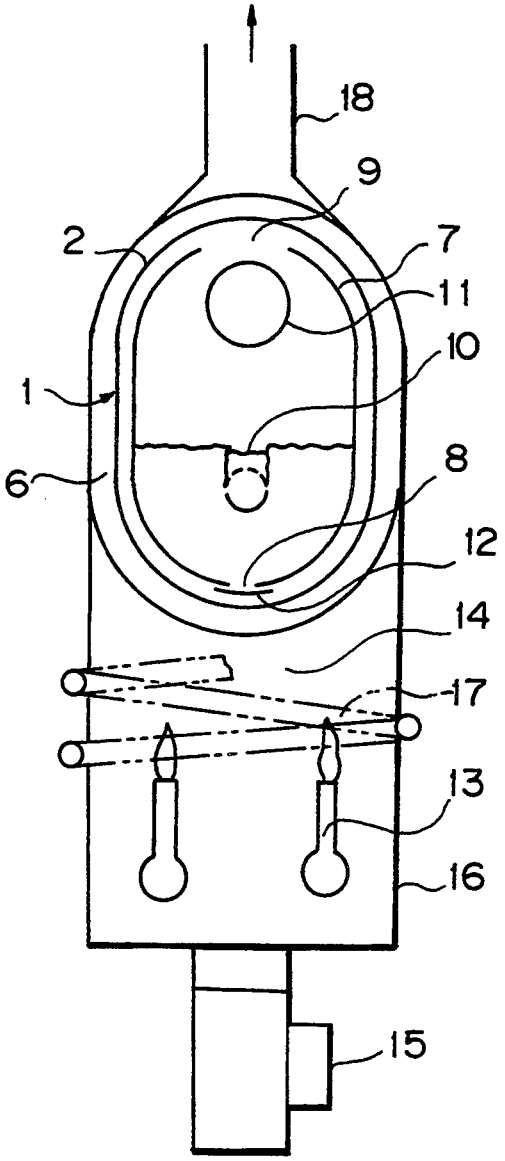
FIG. 2 is a sectional side view of the embodiment shown in FIG. 1.

FIG. 1 is a sectional front view showing one embodiment of the present invention. FIG. 2 is a sectional side view of the embodiment shown in FIG. 1.

Referring to FIGS. 1 and 2, a generator 1 has a dilute solution inlet 3, a solution outlet 4 having an overflow weir 10, and a vapor outlet 5 having a downwardly facing opening 11. The dilute solution inlet 3, the solution outlet 4, and the vapor outlet 5 are provided on the side of the drum shell 2 of the generator. A multiplicity of heat transfer fins 6 are provided on the outer periphery of a drum shell 2 of the generator 1. A circulation guide 7 is provided along the inner periphery of the drum shell 2. The circulation guide 7 has openings 8 and 9 respectively provided in the bottom and top thereof. A boiling preventing plate 12 is installed at the bottom opening 8.

The lower part of the generator i is provided with a combustion chamber 14 where a burner 13 is installed. The generator 1 is heated by combustion gas from the burner 13, and the combustion gas is discharged from an exhaust guide 18. Reference numeral 15 denotes a burner fan, 16 a combustion chamber cover, and 17 a solution preheater disposed along a side wall of the combustion chamber.

The operation of the generator, arranged as described above, will be explained below.

The absorbent solution in the generator 1 enters the area between the drum shell 2 and the circulation guide 7 through the bottom opening 8 of the guide 7. The boiling preventing plate 12 is disposed below the opening 8 to prevent bubbles vapor from closing the opening 8. The solution is heated in the area between the drum shell 2 and the circulation guide 7 to generate vapor, resulting in a vapor-liquid mixed phase condition. Consequently, the specific gravity of the solution decreases, causing an upward flow. The absorbent solution, which is in the vapor-liquid mixed phase condition, flows out from the top opening 9 of the circulation guide 7. The vapor is separated from the liquid in the top space. The solution returns to the inside of the drum shell of the generator and reenters the circulation passage through the bottom opening 8 so as to be heated and recirculated. The vapor separated from the liquid flows out through the vapor outlet 5.

As a result of the generation of vapor, the solution becomes a concentrated solution. Part of this solution flows out through the overflow weir 10. However, by virtue of the presence of the overflow weir 10, the quantity of solution held in the drum shell 2 of the generator 1 is kept greater than a predetermined value. The dilute solution is preheated in the solution preheater 17 before being supplied into the drum shell of the generator and then mixed with the solution in the drum shell of the generator. The resulting mixture enters the circulation passage through the bottom opening 8 of the circulation guide 7 to repeat the above-described process.

Thus, the area between the drum shell 2 and the circulation guide 7 is equivalent to the heat transfer part of the once-through type of generator. Accordingly, the solution flows actively, thus enabling heat transfer of high efficiency.

Figure 3:
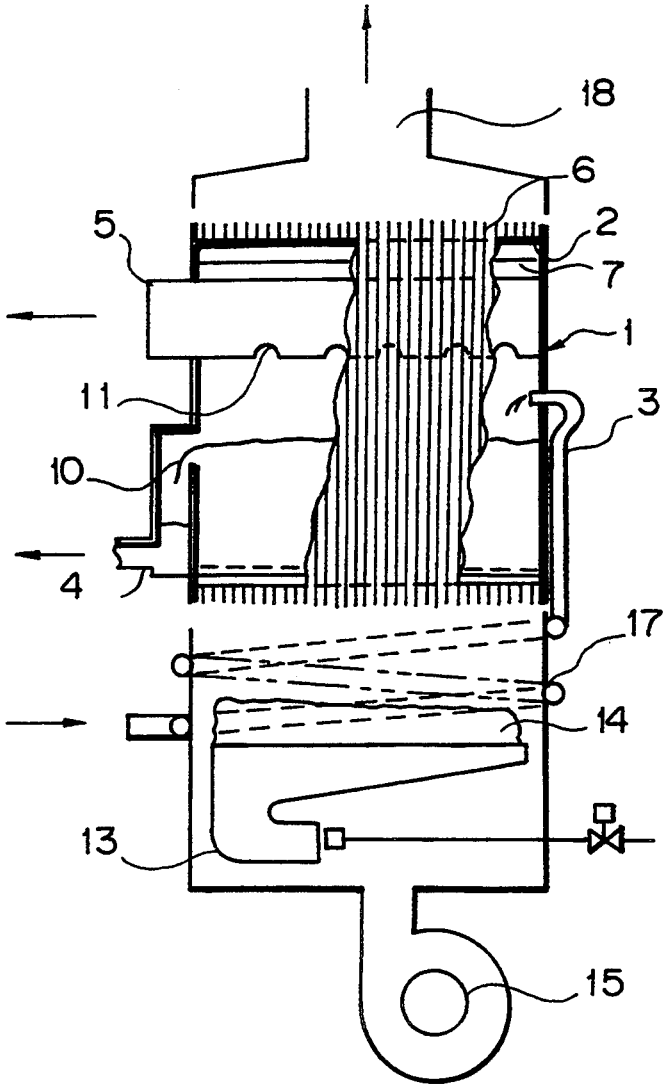
FIG. 3 is a sectional front view showing another embodiment of the present invention.
Figure 4:
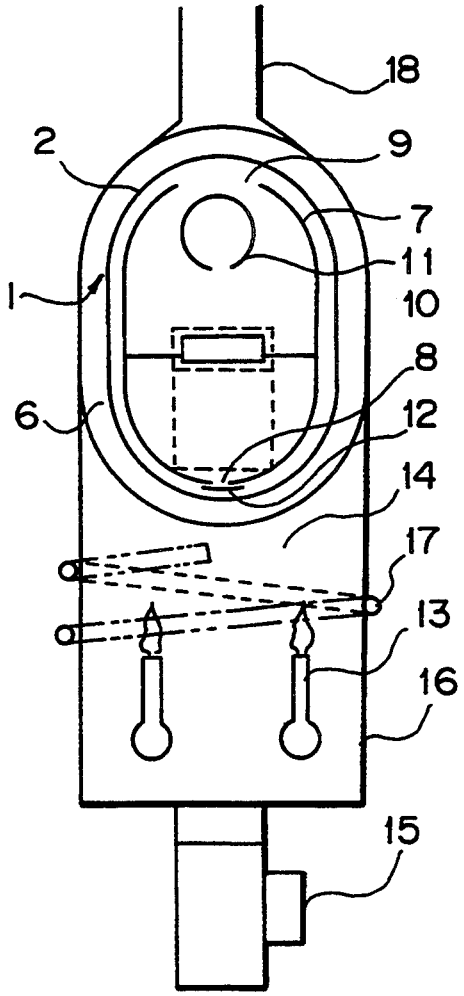
FIG. 4 is a sectional side view of the embodiment shown in FIG. 3.

FIG. 3 is a sectional front view showing another embodiment of the present invention. FIG. 4 is a sectional side view of the embodiment shown in FIG. 3. In the embodiment shown in FIGS. 3 and 4, the overflow weir 10 is provided on a lateral end face of the drum shell of the generator 1, and a plurality of downwardly facing openings 11 are provided in a vapor tube of the vapor outlet 5 that extends inside the drum shell 2. The other parts are the same as those in the embodiment shown in FIGS. 1 and 2, and the functions of these parks are the same as those in the first-described embodiment.

Embodiment 2

Figure 5:
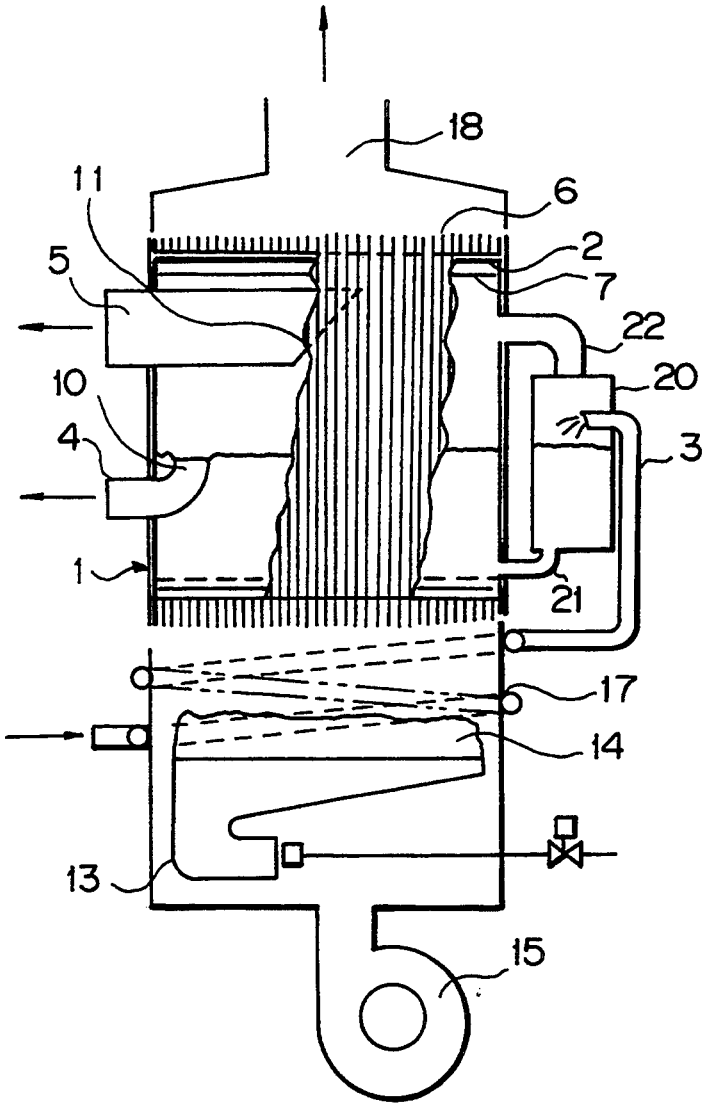
FIG. 5 is a sectional front view showing an embodiment which is provided with a mixing chamber according to the present invention.
Figure 6:
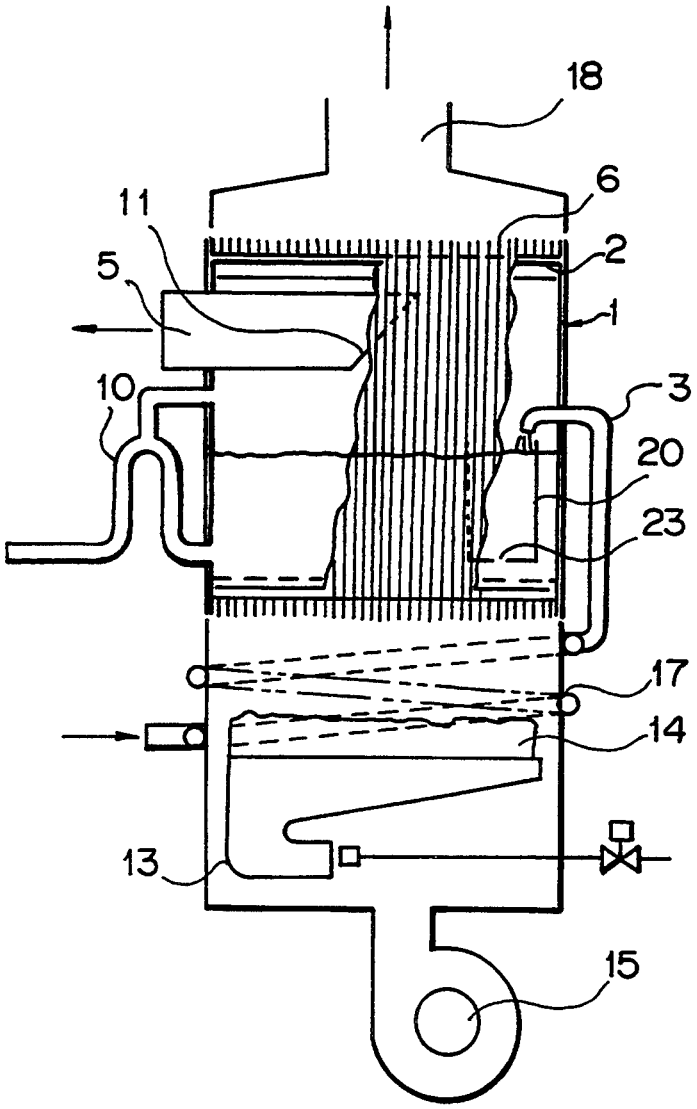
FIG. 6 is a sectional front view showing another embodiment which is provided with a mixing chamber according to the present invention.

FIGS. 5 and 6 are sectional front views showing embodiments which are provided with a mixing chamber according to the present invention.

In the embodiment shown in FIG. 5, a mixing chamber 20 is provided outside the side surface of the drum shell of the generator 1. The mixing chamber 20 is communicated with the inside of the drum shell through a tube 21 so that the solution in the drum shell is mixed with the dilute solution supplied from the solution inlet 8. Vapor generated is discharged to the vapor-phase part in the drum shell of the generator 1 through a tube 22.

In the embodiment shown in FIG. 6, the mixing chamber 20 is provided inside the drum shell and the overflow weir 10 formed at a portion of an overflow tube disposed outside the drum shell of the generator 1. The mixing chamber 20 has openings 23 in the bottom thereof to communicate with the solution in the can.

In the embodiments shown in FIGS. 5 and 6, the other arrangements are the same as those of the embodiment shown in FIGS. 1 and 2, and there is no difference in function between these embodiments.

In the embodiments shown in FIGS. 5 and 6, arranged as described above, the dilute solution from the solution inlet 3 is released into the mixing chamber 20 where it mixed with the solution from the inside of the drum shell. Although vigorous boiling occurs due to the heat of mixing generated at this time, bubbles rise and are separated from the liquid in the top part. Then, the vapor and the liquid return to the inside of the drum shell. A lowering in the apparent specific gravity due to bubbles has no effect on the specific gravity of the solution in the drum shell. Accordingly, there is no influence on the circulation of the vapor-liquid mixture in the area between the drum shell 2 and the circulation guide 7.

Thus, the dilute solution is mixed with the solution in the drum shell in the mixing chamber 20 and supplied to the inside of the drum shell at an intermediate concentration and further mixed with the solution in the drum shell. The resulting mixture enters the circulation passage through the bottom opening 8 of the circulation guide 7 to repeat the above-described process.

Thus, the area between the drum shell 2 and the circulation guide 7 is equivalent to the heat transfer art of the once-through type of generator. Accordingly, the solution flows actively, thus enabling heat transfer of high efficiency.

(Effect of the Invention)

The present invention, arranged as described above, is a generator which is intermediate between the flooded type and the once-through type. Accordingly, it is possible to obtain a generator for an absorption refrigerating machine which has both the stability of the flooded type and the high efficiency heat transfer characteristics of the once-through type.

What is claimed is:

1. A generator for an absorption refrigerating machine which uses combustion gas as a heat source, said generator comprising; a drum shell (2) having an interior containing a body of solution defining a liquid space and a vapor space within said drum shell; a dilute solution inlet communicating with said drum shell interior; a solution outlet means communicating with said liquid space in said drum shell having an overflow weir 10 for controlling the flow of solution from said drum shell; a vapor outlet communicating with said drum shell vapor space; a multiplicity of heat transfer fins provided on an outer periphery of said drum shell for transfer of heat from said combustion gas to said drum shell so as to heat said solution contained in said drum shell; and a circulation guide (7) spaced from an inner periphery of said drum shell to define a flow conducting passage thereabout, said circulation guide having openings (8, 9) respectively provided in a bottom and top thereof to communicate with said drum shell liquid and vapor spaces, respectively, so that said solution in said drum shell is heated and flows upwardly in the area between said inner periphery of said drum shell and said circulation guide, flows from said opening in the top of said circulation guide to return to said drum shell interior and recirculates through said bottom opening of said circulation guide, whereby vapor is generated in said drum shell and separated from liquid in the liquid space of said solution therein and flows from said vapor outlet, and said solution is concentrated and flows from said generator out through said overflow weir.

2. A generator according to claim 1, wherein said vapor outlet has a downwardly facing opening (11) communicating with said vapor space inside said drum shell, said opening of said vapor outlet being disposed above said overflow weir (10).

3. A generator according to claim 1, further comprising a boiling preventing plate (12) disposed below said bottom opening (8) of said circulation guide within said drum shell so as to prevent said vapor from closing said bottom opening.

4. A generator according to claim 1, further comprising a combustion chamber (14) below said drum shell, said combustion chamber having a burner to generate said combustion gas.

5. A generator according to claim 4, further comprising a solution preheater (17) having a tube disposed along a side wall of said combustion chamber (14) for heating a dilute solution in said tube before entering said drum shell.

6. A generator according to claim 1, wherein said overflow weir is provided on a lateral end face of said drum shell.

7. A generator according to claim 1, further comprising a mixing chamber (20) which is separated from said solution residing in said drum shell and where said solution in said drum shell and a dilute solution from said inlet mix with each other.

8. A generator according to claim 7, wherein said mixing chamber is disposed within said drum shell.

9. A generator according to claim 7, wherein said mixing chamber is disposed outside of said drum shell.

10. A generator according to claim 9, wherein said mixing chamber has an opening in the bottom thereof to communicate with said solution in said drum shell, and an opening at an upper portion thereof to communicated with an upper portion of said drum shell to discharge vapor from said mixing chamber into said drum shell.

11. A generator according to claim 2, further comprising a mixing chamber (20) which is separated from a solution residing in said drum shell and where said solution in said drum shell and a dilute solution from said inlet mix with each other.

12. A generator according to claim 11, wherein said mixing chamber is disposed within said drum shell.

13. A generator according to claim 1, wherein said overflow welt is formed at a portion of an overflow tube.

* * * * *